US010021960B1

(12) United States Patent
Douglas et al.

(10) Patent No.: US 10,021,960 B1
(45) Date of Patent: Jul. 17, 2018

(54) PAINTBRUSH AND METHOD OF USE

(71) Applicants: Terry Ray Douglas, Surrey (CA); Lloyd Emerson Philip, Mission (CA)

(72) Inventors: Terry Ray Douglas, Surrey (CA); Lloyd Emerson Philip, Mission (CA)

( * ) Notice: Subject to any disclaimer, the term of this patent is extended or adjusted under 35 U.S.C. 154(b) by 0 days.

(21) Appl. No.: 15/677,540

(22) Filed: Aug. 15, 2017

(51) Int. Cl.
*A46B 7/04* (2006.01)
*B05D 1/28* (2006.01)

(52) U.S. Cl.
CPC ..... *A46B 7/042* (2013.01); *B05D 1/28* (2013.01); *A46B 2200/202* (2013.01)

(58) Field of Classification Search
CPC ..... A46B 7/042; A46B 2200/202
See application file for complete search history.

(56) References Cited

U.S. PATENT DOCUMENTS 4,790,679 A * 12/1988 Murphy ..... A46B 7/04 401/146
5,435,037 A 7/1995 Ledingham
6,035,481 A 3/2000 Douglas
6,295,685 B1 10/2001 Douglas
6,510,578 B1 * 1/2003 Cyr ..... A46B 7/04 15/176.1
7,805,797 B2 10/2010 Douglas
9,414,669 B2 8/2016 Fleischer

* cited by examiner

*Primary Examiner* — Randall Chin
(74) *Attorney, Agent, or Firm* — Ted Masters

(57) ABSTRACT

A paintbrush includes a bristle assembly which has a bristle housing to which a plurality of bristles are connected. The bristle housing has a first connector which is spaced apart from a second connector. A handle includes a holder which has cavity which is shaped and dimensioned to removably receive the bristle housing. The handle also includes spaced apart first and second resilient arms, the first resilient arm has a first arm connector and the second resilient arm has a second arm connector. The bristle housing is positionable in the cavity of the holder so that the first connector engages the first arm connector and the second connector engages the second arm connector thereby locking the bristle housing within the cavity. The first resilient arm and the second resilient arm are also positionable to a release position so that the first arm connector is disengaged from the first connector and the second arm connector is disengaged from the second connector so that the bristle housing can be removed from the holder.

14 Claims, 9 Drawing Sheets

Fig. 7
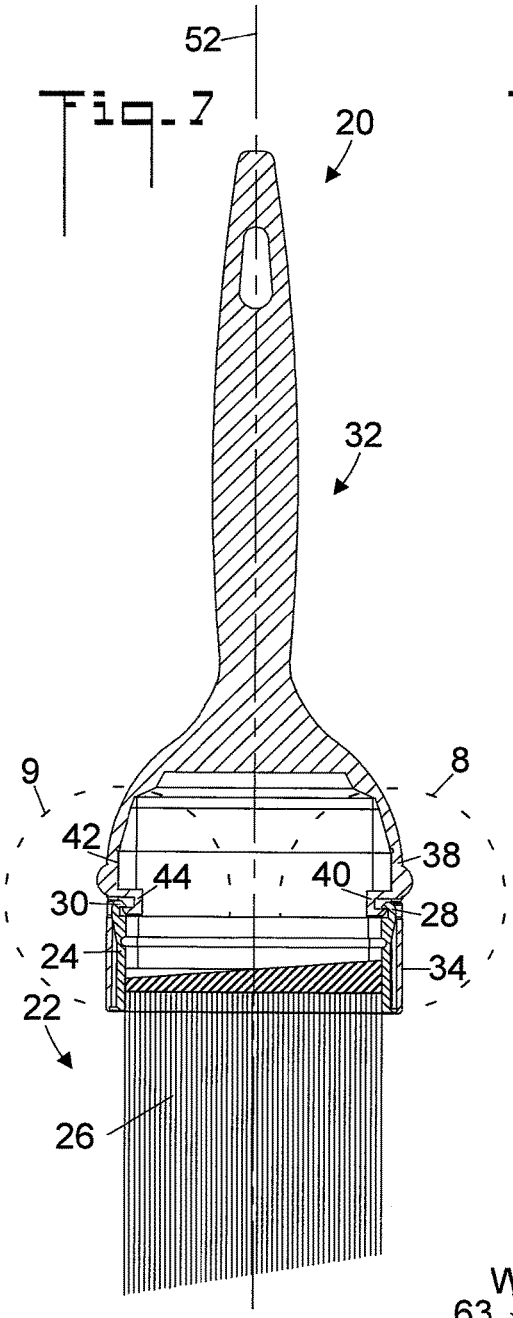
Fig. 8
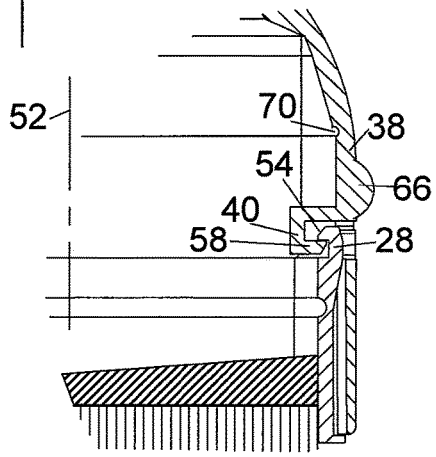
Fig. 9
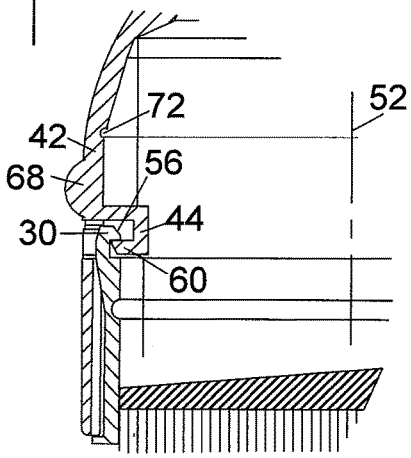
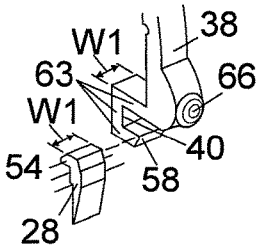
Fig. 10

Fig. 11
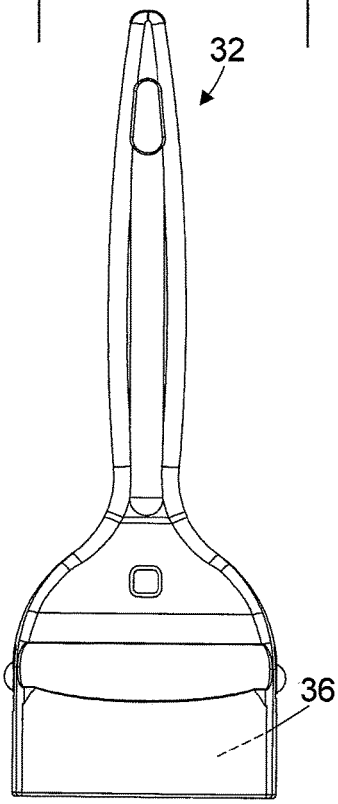
Fig. 12
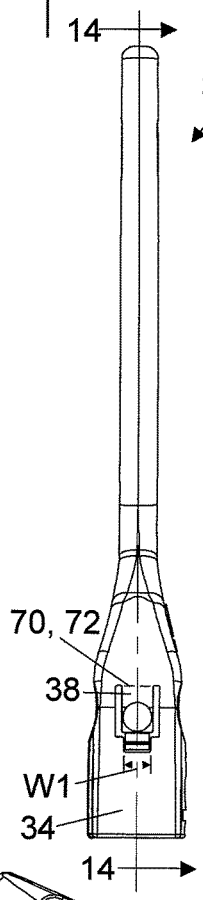
Fig. 14
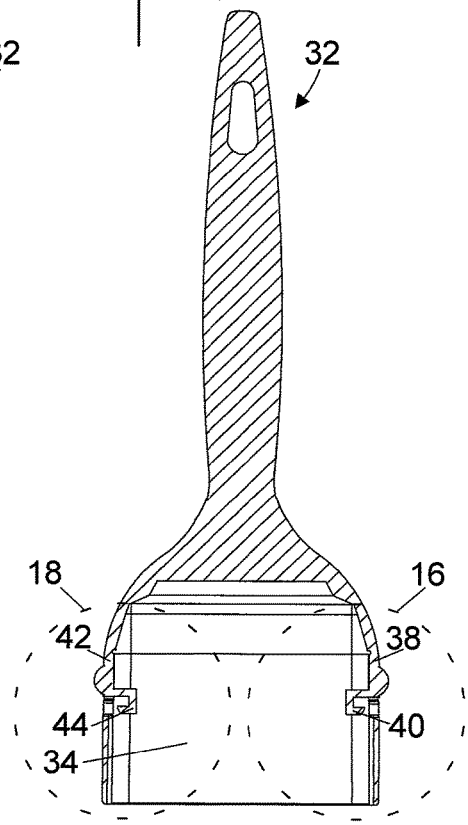
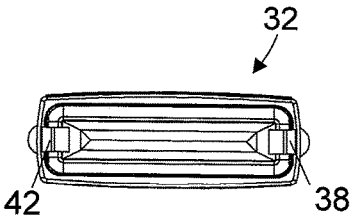
Fig. 13
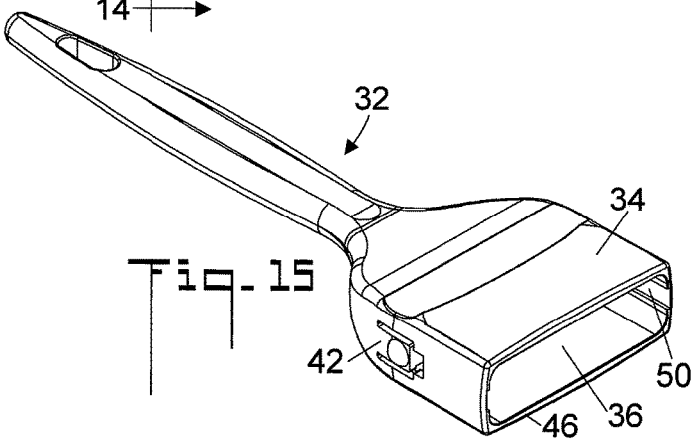
Fig. 15

PAINTBRUSH AND METHOD OF USE

CROSS REFERENCE TO RELATED APPLICATION

None

TECHNICAL FIELD

The present invention pertains to painting, and more particularly to a paintbrush which has a handle which receives a removable bristle assembly.

BACKGROUND OF THE INVENTION

Conventional paintbrushes include bristles which are attached to a handle. The bristles are typically inserted into a metal head and after gluing the head is attached to a handle with staples if plastic and nails if wood. This has to be done carefully using a handle and metal head that have precise measurements to prevent a loose fit. Some manufacturers prefer plastic or composite handles because unlike wood they do not shrink or expand due to humidity or dryness. A major challenge in manufacturing a paintbrush is attaching the head of the brush (that part which contains the bristles) securely to the handle, regardless of whether the handle is plastic or wood. Heat or moisture can cause shrinkage or swelling and this creates a loose fit and annoying movement while the user is painting brush strokes.

To mitigate the above-cited problems, some paintbrush designs include a replaceable head which removably connects to the handle. This concept of a standardized design facilitates head manufacture, and also allows the handle to be reused with multiple heads.

BRIEF SUMMARY OF THE INVENTION

The present invention is directed to a paintbrush which has a replaceable bristle assembly which includes a bristle housing to which bristles are connected. As such, when the bristles of the paintbrush become worn or otherwise unusable, a new bristle assembly can be installed in the handle in a few seconds, avoiding the need for a new handle. Both the bristle housing and the handle can be produced by injection molding thereby ensuring precise manufacturing tolerances. This removable design eliminates the time consuming procedure of attaching the bristle head with nails to a wooden handle or with staples to a plastic handle.

The bristle assembly is insertable into a cavity in the handle, and is removably connected by spaced apart connectors. The design ensures a secure fit which prevents the bristle assembly from moving with respect to the handle. Two release buttons are simultaneously pressed with one hand to disengage the connectors and allow the bristle assembly to be removed it from the handle.

In accordance with an embodiment, a paintbrush includes a bristle assembly which includes a bristle housing to which a plurality of bristles are connected. The bristle housing has a first side which has a first connector and an opposite second side which has a second connector. A handle includes a holder which has a first side and an opposite second side, the holder has a cavity which is shaped and dimensioned to removably receive the bristle housing. A first resilient arm is disposed at the first side of the holder, the first resilient arm has a first arm connector which is shaped and dimensioned to engage the first connector of the bristle housing. A second resilient arm is disposed at the second side of the holder, the second resilient arm has a second arm connector which is shaped and dimensioned to engage the second connector of the bristle housing. The bristle housing is positionable in the cavity of the holder so that the first connector engages the first arm connector and the second connector engages the second arm connector thereby locking the bristle housing within the cavity. The first resilient arm and the second resilient arm are positionable so that the first arm connector is disengaged from the first connector and the second arm connector is disengaged from the second connector so that the bristle housing is removable from the holder.

In accordance with another embodiment, the first connector is a first hook, the second connector is a second hook, the first arm connector is a first arm hook, and the second arm connector is a second arm hook.

In accordance with another embodiment, the handle has a longitudinal axis. The first hook has an end which projects toward the longitudinal axis. The second hook has an end which projects toward the longitudinal axis. The first arm hook has an end which projects away from the longitudinal axis. The second arm hook has an end which projects away from the longitudinal axis.

In accordance with another embodiment, the end of the first hook and the end of the second hook are each beveled, and the end of the first arm hook and the end of the second arm hook are each beveled.

In accordance with another embodiment, the bristle housing has a width W. The first hook, the second hook, the first arm hook, and the second arm hook each have a width W1 which is at least one third of W.

In accordance with another embodiment, the first arm hook includes three first walls which form a first recess which is shaped and dimensioned to receive the first hook, and the second arm hook includes three second walls which form a second recess which is shaped and dimensioned to receive the second hook.

In accordance with another embodiment, the first resilient arm includes a first release button which is spaced apart from the first arm connector. The second resilient arm includes a second release button which is spaced apart from the second arm connector.

In accordance with another embodiment, the first resilient arm includes a first bending groove, and the second resilient arm includes a second bending groove.

In accordance with another embodiment, the holder has a rim. The bristle housing has a lip which is shaped and dimensioned to abut the rim.

Other embodiments, in addition to the embodiments enumerated above, will become apparent from the following detailed description, taken in conjunction with the accompanying drawings, which illustrate, by way of example, the principles of the paintbrush and method of use.

BRIEF DESCRIPTION OF THE DRAWINGS

FIG. 7 is a cross sectional view along the line 7-7 of FIG. 4;

FIG. 8 is an enlarged view of area 8 of FIG. 7;

FIG. 9 is an enlarged view of area 9 of FIG. 7;

FIG. 10 is a fragmented exploded perspective view of a first hook and a first arm hook;

FIG. 11 is front elevation view of the handle;

FIG. 12 is a side elevation view of the handle;

FIG. 13 is a bottom plan view of the handle;

FIG. 14 is a cross sectional view along the line 14-14 of FIG. 12;

FIG. 15 is a reverse perspective view of the handle;

DETAILED DESCRIPTION OF THE INVENTION

Figure 1:
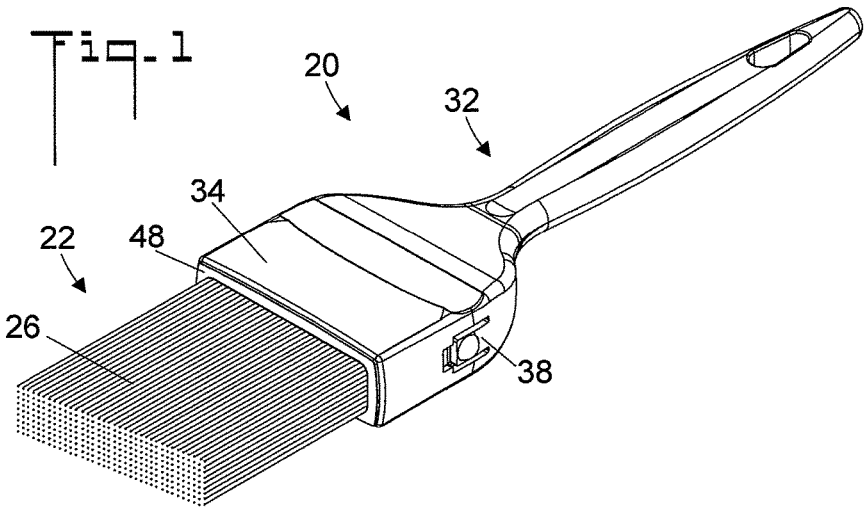
FIG. 1 is a perspective view of a paintbrush.

Referring initially to FIGS. 1-9, a paintbrush 20 includes a bristle assembly 22 (a.k.a. a head or bristle pack) which includes a bristle housing 24 (a.k.a. a ferrule) to which a plurality of bristles 26 are connected. Also referring to FIGS. 25-26, bristle housing 24 has a first side which has a first connector and an opposite second side which has a second connector. In the shown embodiment the first connector is a first hook 28 and the second connector is a second hook 30. As used herein, the term "hook" means a bent or curved member which has a protruding part which is used to catch and hold another member. Paintbrush 20 further includes a handle 32 (also refer to FIGS. 11-15). Handle 32 has a holder 34 which has a first side and an opposite second side and a cavity 36 which is shaped and dimensioned to removably receive bristle housing 24. A first resilient arm 38 is disposed at the first side of holder 34, the first resilient arm 38 has a first arm connector which is shaped and dimensioned to engage the first connector of bristle housing 24. In the shown embodiment, the first arm connector is a first arm hook 40 which is disposed at the distal end of first resilient arm 38, and which is shaped and dimensioned to engage first hook 28. A second resilient arm 42 is disposed at the second side of holder 34, the second resilient arm 42 has a second arm connector which is shaped and dimensioned to engage the second connector of bristle housing 24. In the shown embodiment, the second arm connector is a second arm hook 44 which is disposed at the distal end of second resilient arm 42, and which is shaped and dimensioned to engage second hook 30. Bristle housing 24 is positionable in cavity 36 of holder 34 so that the first connector (first hook 28 as shown) engages the first arm connector (first arm hook 40 as shown), and second connector (second hook 30 as shown) engages the second arm connector (second arm hook 44 as shown) thereby locking the bristle housing 24 within cavity 36. First resilient arm 38 and second resilient arm 42 are positionable to a release position so that the first arm connector (first arm hook 40 as shown) is disengaged from the first connector (first hook 28 as shown), and the second arm connector (second arm hook 44 as shown) is disengaged from the second connector (second hook 30 as shown) so that bristle housing 24 is removable from holder 34. It is noted that the use of two spaced apart connections reduces movement of bristle housing 24 within holder 34, and also eliminates the accidental pressing of a single connector which would inadvertently release bristle housing 24 from holder 34.

Holder 34 has a rim 46. Bristle housing 24 has a lip 48 which is shaped and dimensioned to abut rim 46 when bristle housing 24 is inserted into cavity 36 (refer to FIG. 1). Lip 48 stabilizes bristle housing 24 within holder 34 and prevents it from moving with respect to handle 32. Moreover, lip 48 prevents paint from seeping from bristles 26 into cavity 36.

Figure 2:
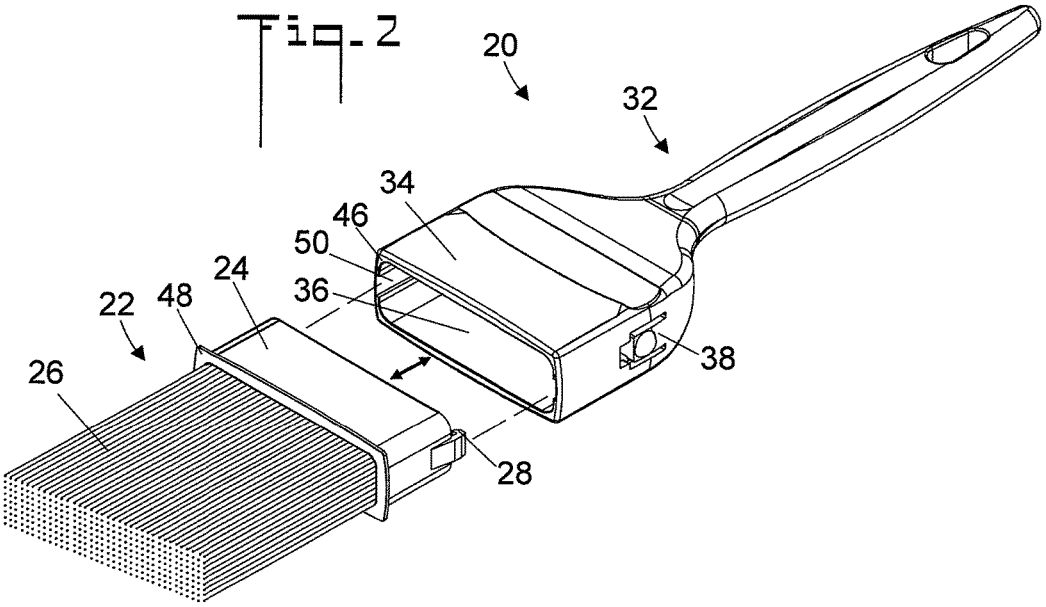
FIG. 2 is a perspective view of the paintbrush with a bristle assembly removed from a handle.
Figure 3:
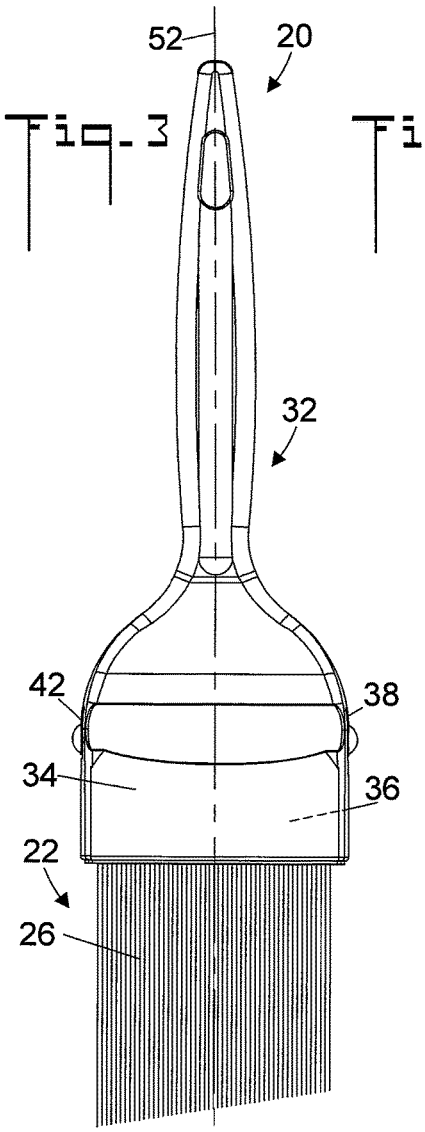
FIG. 3 is front elevation view of the paintbrush.
Figure 4:
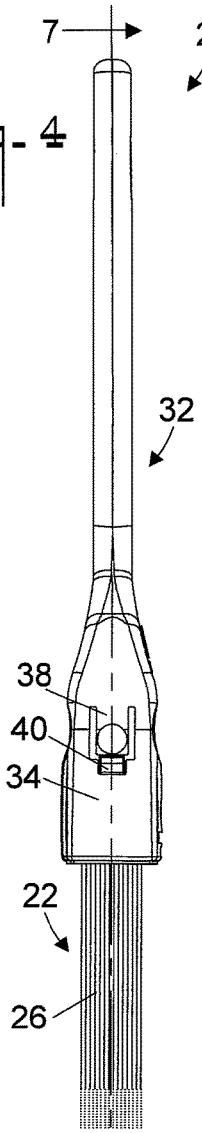
FIG. 4 is a side elevation view of the paintbrush.
Figure 6:
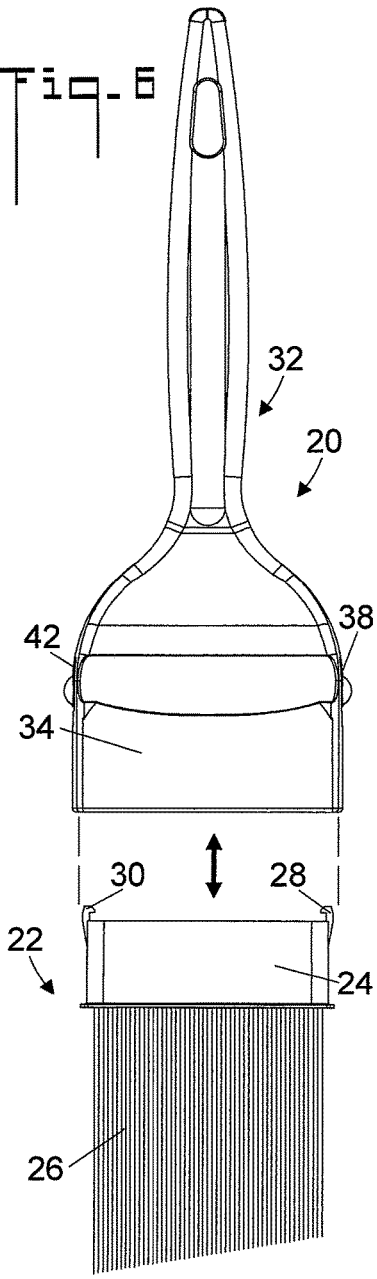
FIG. 6 is a front elevation view of the paintbrush with the bristle assembly removed.
Figure 5:
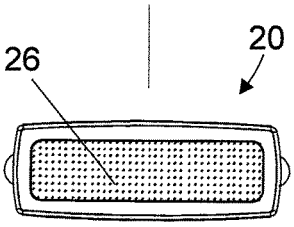
FIG. 5 is a bottom plan view of the paintbrush.
Figure 16:
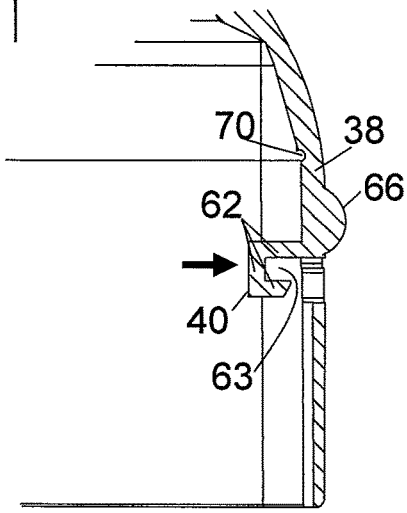
FIG. 16 is an enlarged view of area 16 of FIG. 14.
Figure 17:
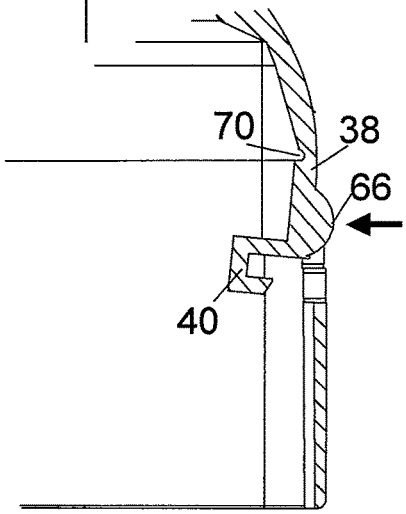
FIG. 17 is an enlarged view as in FIG. 16 with a first release button of a first resilient arm being pressed.
Figure 18:
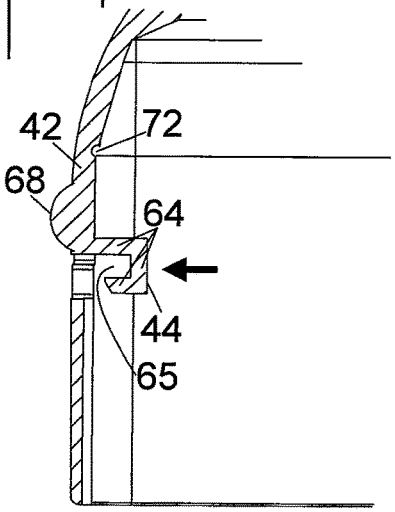
FIG. 18 is an enlarged view of area 18 of FIG. 14.
Figure 19:
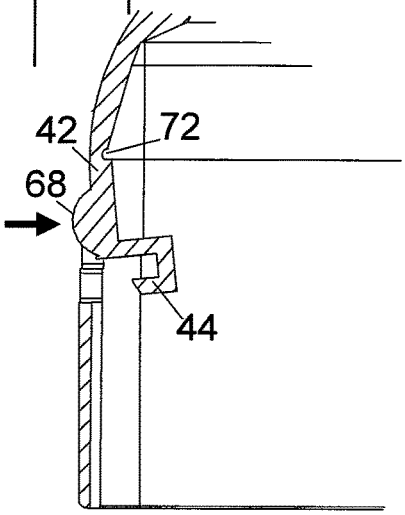
FIG. 19 is an enlarged view as in FIG. 16 with a second release button of a 8 second resilient arm being pressed.

Referring to FIGS. 2 and 15, holder 34 has internal grooves 50 which are shaped and dimensioned to slidably receive first hook 28 and second hook 30 when bristle housing 24 is inserted into holder 34. Grooves 50 serve to stabilize the connection of bristle housing 24 and holder 34 to prevent relative motion thereof.

Referring to FIGS. 7-9, handle 32 has a longitudinal axis 52. When bristle housing 24 is installed in holder 34, first hook 28 has an end 54 which projects toward longitudinal axis 52, and second hook 30 has an end 56 which projects toward longitudinal axis 52. First arm hook 40 has an end 58 which projects away from longitudinal axis 52, and second arm hook 44 has an end 60 which projects away from longitudinal axis 52. Engagement of the hooks occurs when the end 54 of first hook 28 extends past and interlocks with the end 58 of first arm hook 40, and the end 56 of second hook 30 extends past and interlocks with the end 60 of second arm hook 44 so that bristle housing 24 is locked within holder 34. It is further noted that end 54 of first hook 28 and end 56 of second hook 30 are each beveled, and end 58 of first arm hook 40 and end 60 of second arm hook 44 are each beveled. The beveling facilitates the engagement of the hooks when bristle housing 24 is inserted into holder 34 (also refer to FIGS. 33-35 and the associated discussion).

First resilient arm 38 includes a first release button 66 which is spaced apart from the first arm connector (first arm hook 40 as shown). Second resilient arm 42 includes a second release button 68 which is spaced apart from second arm connector (second arm hook 44 as shown). First resilient arm 38 includes a first bending groove 70 and second resilient arm 42 includes a second bending groove 72 (also refer to FIG. 12). FIG. 10 is a fragmented exploded perspective view of first resilient arm 38 with first arm hook 40 having end 58 and first release button 66. First arm hook 40 engages first hook 28 which has end 54. It may be appreciated that second resilient arm 42, second arm hook 44, and second hook 30 have the same structure.

FIGS. 11-15 show various views of handle 32. Shown are holder 34, cavity 36, first resilient arm 38, first arm hook 40, second resilient arm 42, second arm hook 44, rim 46, and groove 50.

FIGS. 16-19 show the operation of first resilient arm 38 and second resilient arm 42. Resilient arms 38 and 42 are fabricated from a material such as a polymer (e.g. polypropylene) which is flexible enough to move when a force is applied, but which will return to its original position when the force is removed. In an embodiment, holder 34 (including resilient arms 38 and 42) and bristle housing 24 are both fabricated from the same polymer by injection molding. Resilient arms 38 and 42 are outwardly biased (normally reside) in the direction of the arrows in FIGS. 16 and 18. To disengage bristle housing 24 from holder 34, first release button 66 is pressed inwardly in the direction of the arrow in FIG. 17, and simultaneously second release button 68 is pressed inwardly in the direction of the arrow in FIG. 19 (also refer to FIGS. 27-29 and the associated discussion). The bending grooves 70 and 72 serve to facilitate the bending of the resilient arms 38 and 42 when they are pressed inwardly. It is also noted that first arm hook 40 includes three first walls 62 which form a first recess 63 which is shaped and dimensioned to receive first hook 28, and that second arm hook 44 includes three second walls 64 which form a second recess 65 which is shaped and dimensioned to receive second hook 30 (refer also to FIG. 10).

Figure 20:
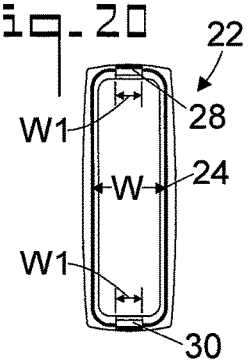
FIG. 20 is top plan view of the bristle assembly.
Figure 24:
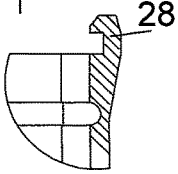
FIG. 24 is an enlarged view of area 24 of FIG. 22.
Figure 21:
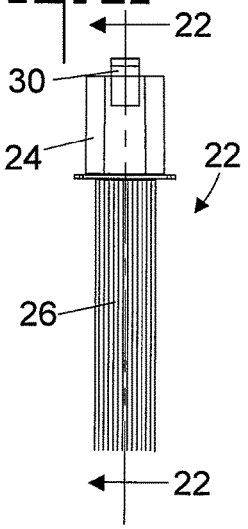
FIG. 21 is a side elevation view of the bristle assembly.
Figure 22:
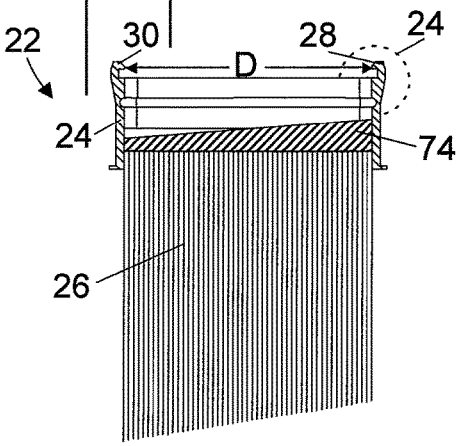
FIG. 22 is a front elevation view of the bristle assembly.
Figure 23:
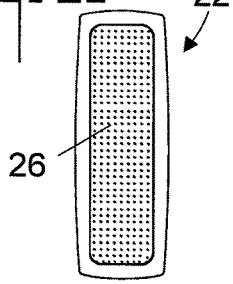
FIG. 23 is a bottom plan view of the bristle assembly.

FIGS. 20-24 show various views of bristle assembly 22. Shown are, bristle housing 24, bristles 26, first hook 28, and second hook 30. In FIG. 20 it is noted that bristle housing 24 has a width W. Also in FIG. 20 it is noted that first hook 28 and second hook 30 each have a width W1 which is at least one third of width W. Referring to FIGS. 10 and 12, it is also noted that first resilient arm hook 40 and second arm hook 44 also have a width W1 which is at least one third of width W. The width of the hooks both ensures that the hooks will always engage, and provides a longer connection which tends to stabilize bristle housing 24 within holder 34. It is noted in FIG. 22, there exists a distance D between first hook 28 and second hook 30. Distance D must be of sufficient length to accommodate the plug tool which is used to align bristles 26 within bristle housing 24. Once inserted, the bristles 26 are permanently connected to bristle housing 24 with a bonding agent such as a glue or epoxy 74.

Figure 25:
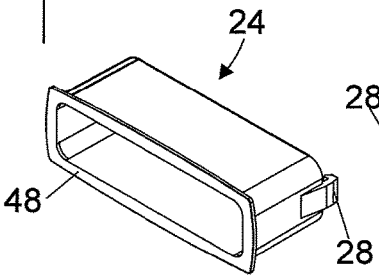
FIG. 25 is a perspective view of a bristle housing.
Figure 26:
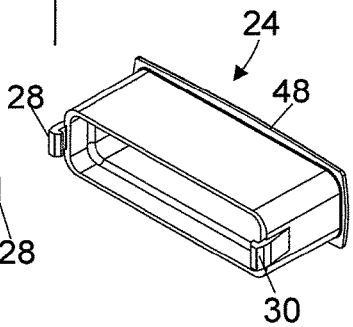
FIG. 26 is a reverse perspective view of the bristle housing.

FIGS. 25 and 26 are perspective and reverse perspective views respectively of bristle housing 44 without bristles 26 installed. Shown are first hook 28, second hook 30, and lip 48.

Figure 27:
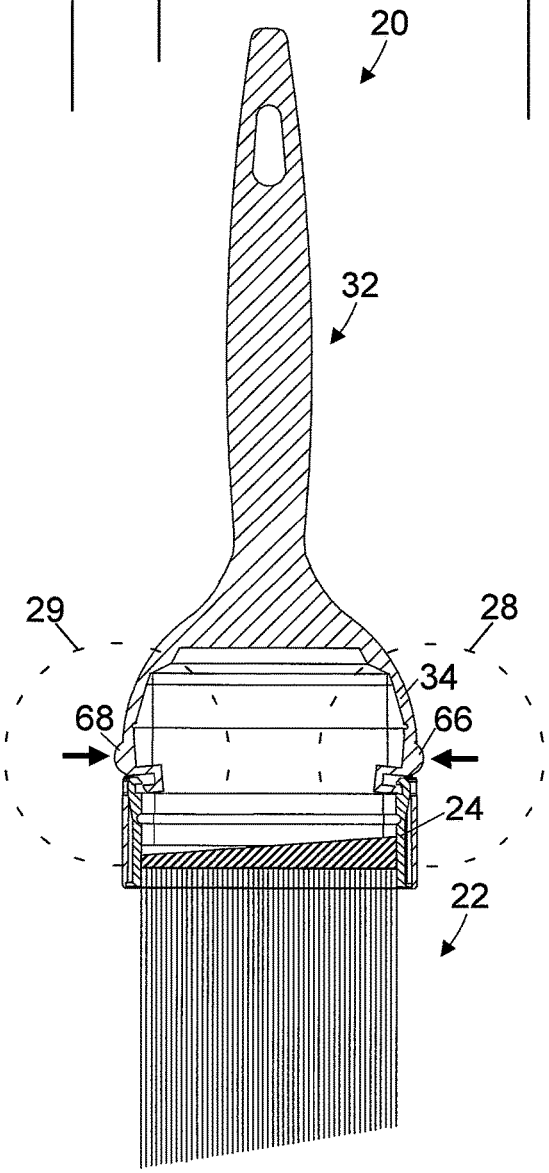
FIG. 27 is cross sectional view as in FIG. 7 with the first and second release buttons pressed.
Figure 28:
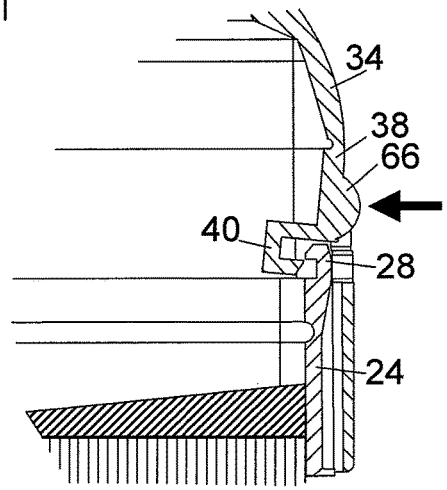
FIG. 28 is an enlarged view of area 28 of FIG. 27.
Figure 29:
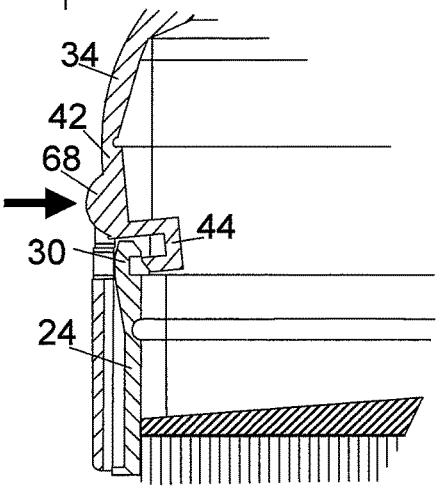
FIG. 29 is an enlarged view of area 29 of FIG. 27.
Figure 30:
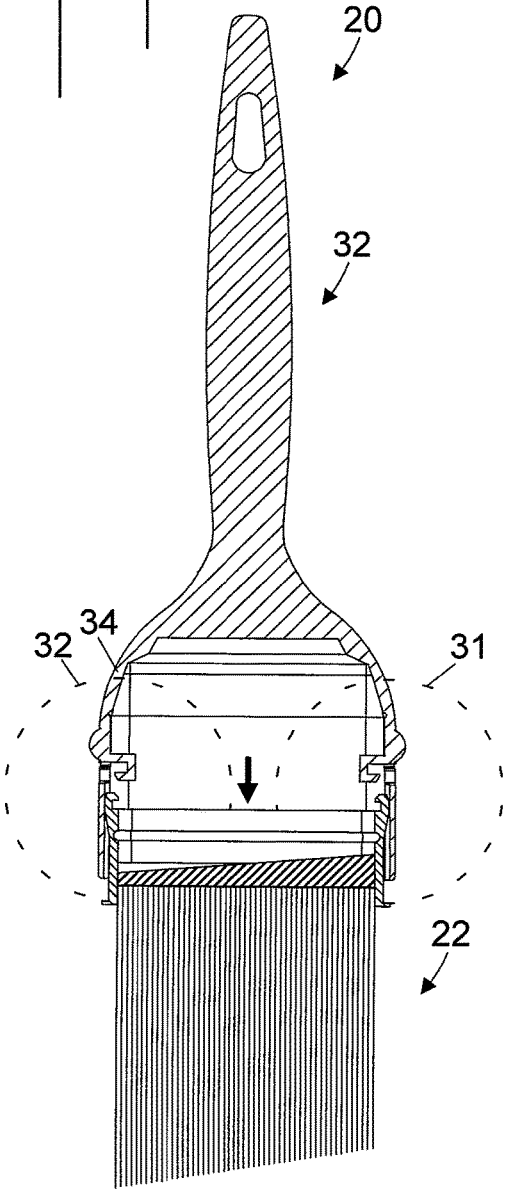
FIG. 30 is a cross sectional view as in FIG. 7 showing the bristle assembly released and being separated from the handle.
Figure 31:
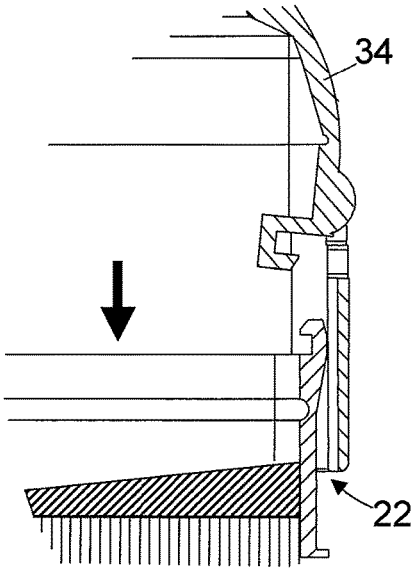
FIG. 31 is an enlarged view of area 31 of FIG. 30.
Figure 32:
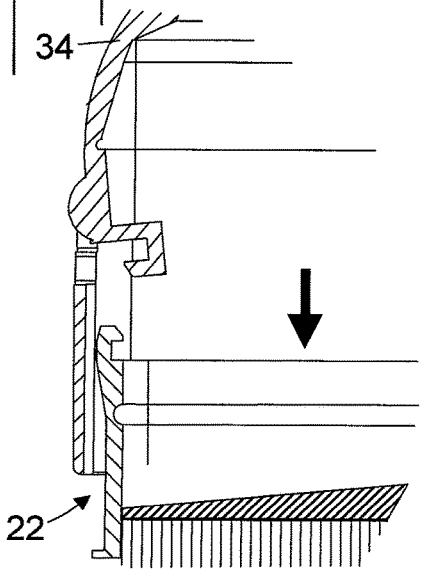
FIG. 32 is an enlarged view of area 32 of FIG. 30.

FIGS. 27-29 show bristle assembly 22 being released from holder 34 of handle 32. From the connected position of FIG. 7, the user simultaneously inwardly presses and holds first release button 66 of first resilient arm 38 and second release button 68 of second resilient arm 42 (toward the longitudinal axis 52 of handle 32, refer to FIG. 7). This causes first arm hook 40 to move inwardly and disengage from first hook 28. and second arm hook 44 to move inwardly and disengage from second hook 30.

After the disengagement of the hooks shown in FIGS. 27-29, FIGS. 30-33 show bristle assembly 22 being separated from the handle 32 by pulling bristle assembly 22 out of holder 34 in the direction of the arrows. It is also noted that after disengagement, pressure upon first release button 66 and second release button 68 is removed so that resilient arms 38 and 42 return to the outwardly biased position of FIG. 14.

Figure 33:
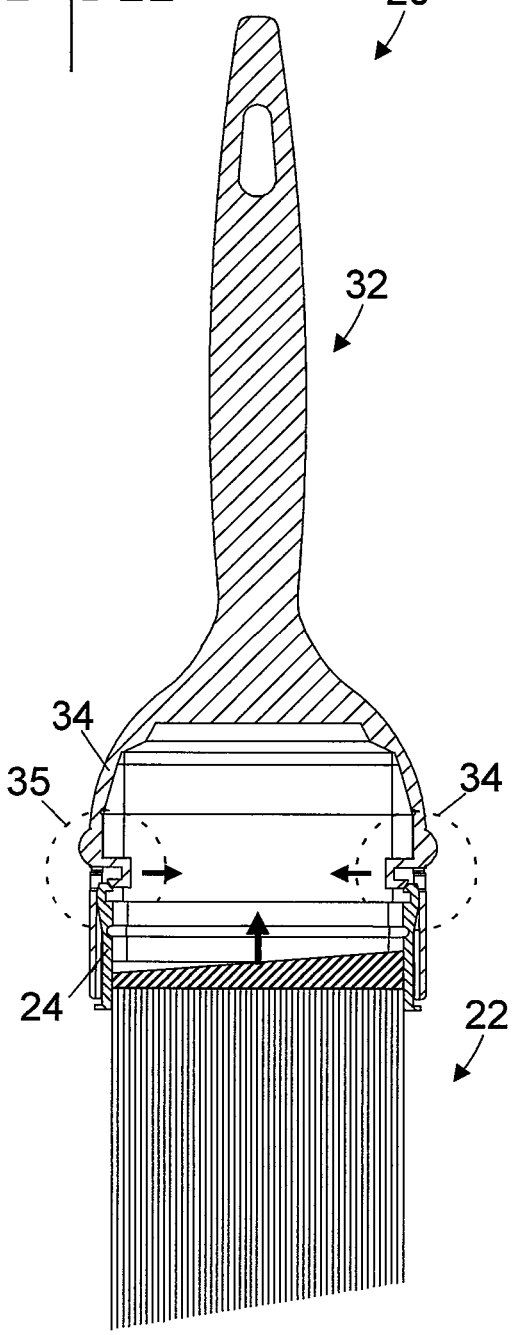
FIG. 33 is a cross sectional view as in FIG. 7, showing the bristle assembly being installed in the handle.
Figure 34:
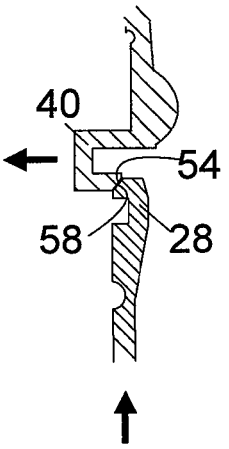
FIG. 34 is an enlarged view of area 34 of FIG. 33.
Figure 35:
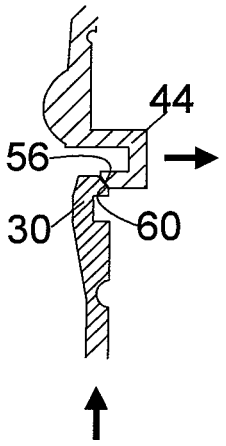
FIG. 35 is an enlarged view of area 35 of FIG. 33.

FIGS. 33-35 are cross sectional views as in FIG. 7, showing bristle assembly 22 being installed in handle 32. Bristle assembly 22 is inserted into holder 34 of handle 32 and pushed in until first hook 28 engages first arm hook 40 and second hook 30 engages second arm hook 44. During the insertion process beveled end 54 of first hook 28 contacts beveled end 58 of first arm hook 40, and beveled end 56 of second hook 30 contacts beveled end 60 of second arm hook 44. As bristle assembly 22 is moved in the direction of the vertical arrows, first hook 28 forces first arm hook 40 inward in the direction of the horizontal arrow, and second hook 30 forces second arm hook 44 inward in the direction of the horizontal arrow. When first hook 28 passes first arm hook 40 and second hook 30 passes second arm hook 44, first arm hook 40 and second arm hook 44 resiliently snap back into the position of FIG. 7. This snapping action causes an audible "click" which is an indication that the bristle assembly 22 is properly seated in holder 34.

In terms of use, a method for using a paintbrush includes:

(a) providing a paintbrush 20 including;

a bristle assembly 22 which includes a bristle housing 24 to which a plurality of bristles 26 are connected;

the bristle housing 24 having a first side which has a first connector 28 and an opposite second side which has a second connector 30;

a handle 32 including a holder 34 which has a first side and an opposite second side, the holder 34 having a cavity 36 which is shaped and dimensioned to removably receive the bristle housing 24;

a first resilient arm 38 disposed at the first side of the holder 34, the first resilient arm 38 having a first arm connector 40 which is shaped and dimensioned to engage the first connector 28 of the bristle housing 24, the first resilient arm 38 also having a first release button 66;

a second resilient arm 42 disposed at the second side of the holder 34, the second resilient arm 42 having a second arm connector 44 which is shaped and dimensioned to engage the second connector 30 of the bristle housing 24, the second resilient arm 42 having a second release button 68;

the bristle housing 24 is positionable in the cavity 36 of the holder 34 so that the first connector 28 engages the first arm connector 40 and the second connector 30 engages the second arm connector 44 thereby locking the bristle housing 24 within the cavity 36;

the first resilient arm 38 and the second resilient arm 42 are positionable so that the first arm connector 40 is disengaged from the first connector 28 and the second arm connector 44 is disengaged from the second connector 30 so that the bristle housing 24 is removable from the holder 34;

(b) inserting the bristle assembly 22 into the holder 34 until the first connector 28 engages the first arm connector 40, and the second connector 30 engages the second arm connector 44; and, (c) using the paintbrush 20.

The method further including:

in (b), an audible click being produced when the first connector 28 engages the first arm connector 40, and the second connector 30 engages the second arm connector 44.

The method further including:

after (c), simultaneously pressing the first release button 66 and the second release button 68 so that the first connector 28 disengages from the first arm connector 40 and the second connector 30 disengages from the second arm connector 44; and, removing the bristle assembly 22 from the holder 34.

The method further including:

in (a), the first connector 28 being a first hook, the second connector 30 being a second hook, the first arm connector being a first arm hook 40; and the second arm connector being a second arm hook 44.

The method of claim 11, further including:

in (a), the holder 34 having a rim 46, and the bristle housing 24 having a lip 48 which is shaped and dimensioned to abut the rim 46; and, in (b), the lip 48 abutting the rim 46.

Note: Unless specifically otherwise stated, and as applicable, the order of performance of the above cited method steps can be changed.

The embodiments of the paintbrush and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the paintbrush and method should be construed as limiting the invention to a particular embodiment or combination of embodiments. The scope of the invention is defined by the appended claims.

We claim:

1. A paintbrush, comprising:

a bristle assembly which includes a bristle housing to which a plurality of bristles are connected;

said bristle housing having a first side which has a first connector and an opposite second side which has a second connector;

a handle including a holder which has a first side and an opposite second side, said holder having a cavity which is shaped and dimensioned to removably receive said bristle housing;

a first resilient arm disposed at said first side of said holder, said first resilient arm having a first arm connector which is shaped and dimensioned to engage said first connector of said bristle housing;

a second resilient arm disposed at said second side of said holder, said second resilient arm having a second arm connector which is shaped and dimensioned to engage said second connector of said bristle housing;

said bristle housing is positionable in said cavity of said holder so that said first connector engages said first arm connector and said second connector engages said second arm connector thereby locking said bristle housing within said cavity;

said first resilient arm and said second resilient arm are positionable so that said first arm connector is disengaged from said first connector and said second arm connector is disengaged from said second connector so that said bristle housing is removable from said holder;

said first resilient arm including a first release button;

said first release button is spaced apart from said first arm connector;

said second resilient arm including a second release button; and, said second release button is spaced apart from said second arm connector.

2. The paintbrush according to claim 1, further including:

said first connector being a first hook;

said second connector being a second hook;

said first arm connector being a first arm hook; and, said second arm connector being a second arm hook.

3. The paintbrush according to claim 2, further including:

said handle having a longitudinal axis;

said first hook having an end which projects toward said longitudinal axis;

said second hook having an end which projects toward said longitudinal axis;

said first arm hook having an end which projects away from said longitudinal axis; and, said second arm hook having an end which projects away from said longitudinal axis.

4. The paintbrush according to claim 2, further including:

said bristle housing having a width W; and, said first hook, said second hook, said first arm hook, and said second arm hook each having a width W1 which is at least one third of W.

5. The paintbrush according to claim 2, further including:

said first arm hook including three first walls which form a first recess which is shaped and dimensioned to receive said first hook; and, said second arm hook including three second walls which form a second recess which is shaped and dimensioned to receive said second hook.

6. The paintbrush according to claim 1, further including:

said first resilient arm including a first bending groove; and, said second resilient arm including a second bending groove.

7. The paintbrush according to claim 1, further including:

said first connector being a first hook;

said second connector being a second hook;

said first arm connector being a first arm hook;

said second arm connector being a second arm hook;

said handle having a longitudinal axis;

said first hook having an end which projects toward said longitudinal axis;

said second hook having an end which projects toward said longitudinal axis;

said first arm hook having an end which projects away from said longitudinal axis;

said second arm hook having an end which projects away from said longitudinal axis;

said end of said first hook and said end of said second hook each being beveled;

said end of said first arm hook and the end of said second arm hook each being beveled;

said first arm hook including three first walls which form a first recess which is shaped and dimensioned to receive said first hook;

said second arm hook including three second walls which form a second recess which is shaped and dimensioned to receive said second hook;

said first resilient arm including a first bending groove;

said second resilient arm including a second bending groove;

said holder having a rim; and, said bristle housing having a lip which is shaped and dimensioned to abut said rim.

8. A paintbrush, comprising:

a bristle assembly which includes a bristle housing to which a plurality of bristles are connected;

said bristle housing having a first side which has a first connector and an opposite second side which has a second connector;

a handle including a holder which has a first side and an opposite second side, said holder having a cavity which is shaped and dimensioned to removably receive said bristle housing;

a first resilient arm disposed at said first side of said holder, said first resilient arm having a first arm connector which is shaped and dimensioned to engage said first connector of said bristle housing;

a second resilient arm disposed at said second side of said holder, said second resilient arm having a second arm connector which is shaped and dimensioned to engage said second connector of said bristle housing;

said bristle housing is positionable in said cavity of said holder so that said first connector engages said first arm connector and said second connector engages said second arm connector thereby locking said bristle housing within said cavity;

said first resilient arm and said second resilient arm are positionable so that said first arm connector is disengaged from said first connector and said second arm connector is disengaged from said second connector so that said bristle housing is removable from said holder;

said first connector being a first hook;

said second connector being a second hook;

said first arm connector being a first arm hook;

said second arm connector being a second arm hook;

said handle having a longitudinal axis;

said first hook having an end which projects toward said longitudinal axis;

said second hook having an end which projects toward said longitudinal axis;

said first arm hook having an end which projects away from said longitudinal axis;

said second arm hook having an end which projects away from said longitudinal axis;

said end of said first hook and said end of said second hook each being beveled; and, said end of said first arm hook and the end of said second arm hook each being beveled.

9. A paintbrush, comprising:

a bristle assembly which includes a bristle housing to which a plurality of bristles are connected;

said bristle housing having a first side which has a first connector and an opposite second side which has a second connector;

a handle including a holder which has a first side and an opposite second side, said holder having a cavity which is shaped and dimensioned to removably receive said bristle housing;

a first resilient arm disposed at said first side of said holder, said first resilient arm having a first arm connector which is shaped and dimensioned to engage said first connector of said bristle housing;

a second resilient arm disposed at said second side of said holder, said second resilient arm having a second arm connector which is shaped and dimensioned to engage said second connector of said bristle housing;

said bristle housing is positionable in said cavity of said holder so that said first connector engages said first arm connector and said second connector engages said second arm connector thereby locking said bristle housing within said cavity;

said first resilient arm and said second resilient arm are positionable so that said first arm connector is disengaged from said first connector and said second arm connector is disengaged from said second connector so that said bristle housing is removable from said holder;

said holder having a rim; and, said bristle housing having a lip which is shaped and dimensioned to abut said rim.

10. A method for using a paintbrush, comprising:

(a) providing a paintbrush including;

a bristle assembly which includes a bristle housing to which a plurality of bristles are connected;

said bristle housing having a first side which has a first connector and an opposite second side which has a second connector;

a handle including a holder which has a first side and an opposite second side, said holder having a cavity which is shaped and dimensioned to removably receive said bristle housing;

a first resilient arm disposed at said first side of said holder, said first resilient arm having a first arm connector which is shaped and dimensioned to engage said first connector of said bristle housing, said first resilient arm also having a first release button which is spaced apart from said first arm connector;

a second resilient arm disposed at said second side of said holder, said second resilient arm having a second arm connector which is shaped and dimensioned to engage said second connector of said bristle housing, said second resilient arm having a second release button which is spaced apart from said second arm connector;

said bristle housing is positionable in said cavity of said holder so that said first connector engages said first arm connector and said second connector engages said second arm connector thereby locking said bristle housing within said cavity;

said first resilient arm and said second resilient arm are positionable so that said first arm connector is disengaged from said first connector and said second arm connector is disengaged from said second connector so that said bristle housing is removable from said holder;

(b) inserting said bristle assembly into said holder until said first connector engages said first arm connector, and said second connector engages said second arm connector; and, (c) using said paintbrush.

11. The method of claim 10, further including:

in (b), an audible click being produced when said first connector engages said first arm connector, and said second connector engages said second arm connector.

12. The method of claim 10, further including:

after (c), simultaneously pressing said first release button and said second release button so that said first connector disengages from said first arm connector and said second connector disengages from said second arm connector; and, removing said bristle assembly from said holder.

13. The method of claim 10, further including:

in (a), said first connector being a first hook, said second connector being a second hook, said first arm connector being a first arm hook; and said second arm connector being a second arm hook.

14. The method of claim 10, further including:

in (a), said holder having a rim, and said bristle housing having a lip which is shaped and dimensioned to abut said rim; and, in (b), said lip abutting said rim.

* * * * *